United States Patent [19]

Clarke

[11] 4,286,438

[45] Sep. 1, 1981

[54] CONDITION RESPONSIVE LIQUID LINE VALVE FOR REFRIGERATION APPLIANCE

[75] Inventor: Clarence C. Clarke, Evansville, Ind.

[73] Assignee: Whirlpool Corporation, Benton Harbor, Mich.

[21] Appl. No.: 146,357

[22] Filed: May 2, 1980

[51] Int. Cl.[3] ..... F25B 41/04

[52] U.S. Cl. ..... 62/216; 62/208; 62/DIG. 17

[58] Field of Search ..... 62/204, 210, 222, 223, 62/511, 216, 498, 208, DIG. 17

[56] References Cited

U.S. PATENT DOCUMENTS

| | | | |
|---|---|---|---|
| 1,836,072 | 12/1931 | Hull | 62/210 |
| 2,075,349 | 3/1937 | Lawton | 62/204 |
| 2,245,454 | 6/1941 | Baker | 62/3 |
| 2,394,109 | 2/1946 | Sanchez | 62/222 |
| 2,434,593 | 1/1948 | Schulz et al. | 62/222 |
| 2,687,020 | 8/1954 | Staebler et al. | 62/198 |
| 3,199,306 | 8/1965 | Paul | 62/158 |
| 3,677,028 | 7/1972 | Raymond | 62/200 |
| 3,722,228 | 3/1973 | Smith | 62/206 |
| 3,884,663 | 5/1975 | Funaro | 62/222 |
| 4,067,203 | 1/1978 | Behr | 62/208 |

*Primary Examiner*—William E. Wayner
*Assistant Examiner*—Harry Tanner
*Attorney, Agent, or Firm*—Wegner, Stellman, McCord, Wood & Dalton

[57] ABSTRACT

An energy efficient refrigeration system having a valve in series with a fixed flow restrictor between the condenser and evaporator of the system. The valve is controlled to permit fluid flow whenever the compressor is running, and when the compressor is not running, only in the event the pressure at the outlet of the compressor is above a preselected pressure. The preselected pressure is a high pressure, such as would prevent starting of the compressor, which, in the illustrated embodiment, is a rotary compressor. The pressure sensing structure, in the illustrated embodiment, utilizes an analog of the pressure of the liquid refrigerant within the condenser and, more specifically, utilizes a temperature condition which corresponds to the liquid pressure therein. Alternatively, the temperature sensing may be of the condenser or of the ambient space in which the condenser is housed. The control valve and associated control circuit are arranged to provide a fail-safe function and assure that the valve is open whenever the compressor is operating.

17 Claims, 5 Drawing Figures

FIG. 1
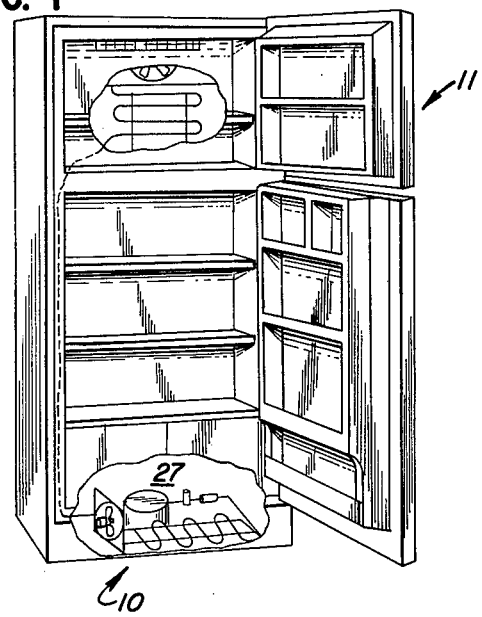
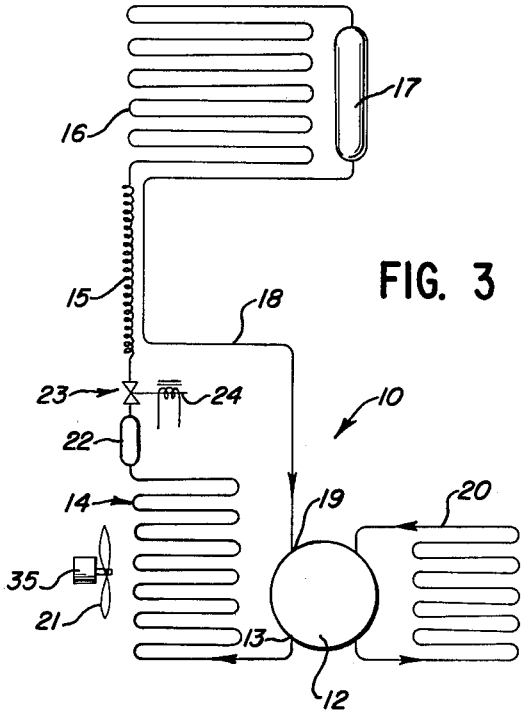
FIG. 3
FIG. 2
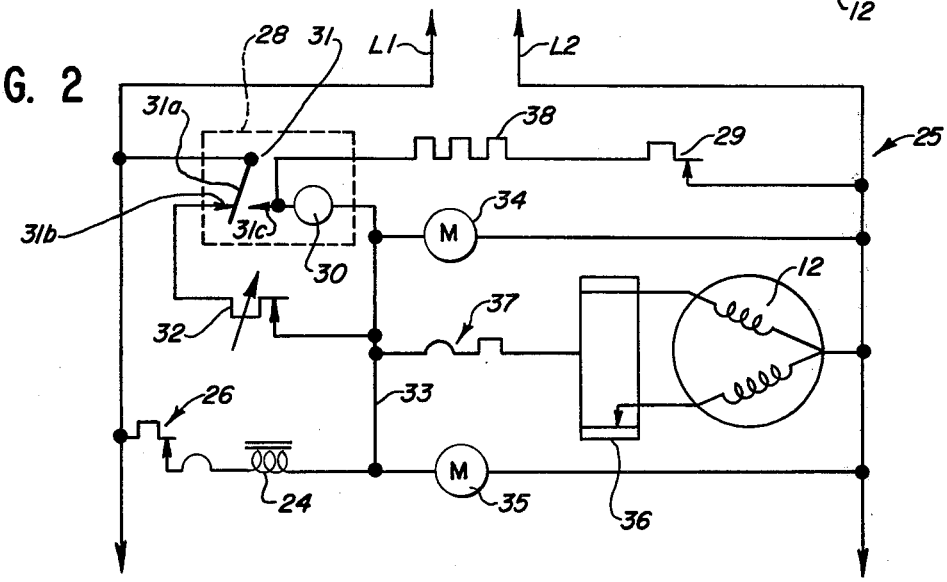
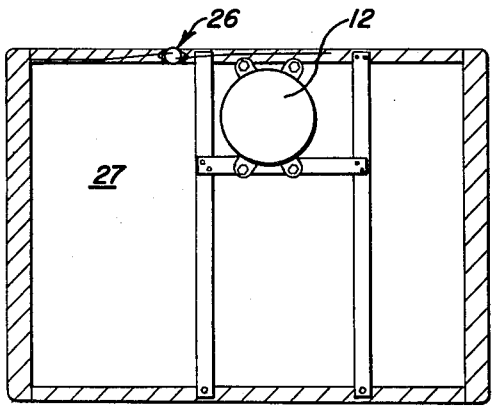
FIG. 4
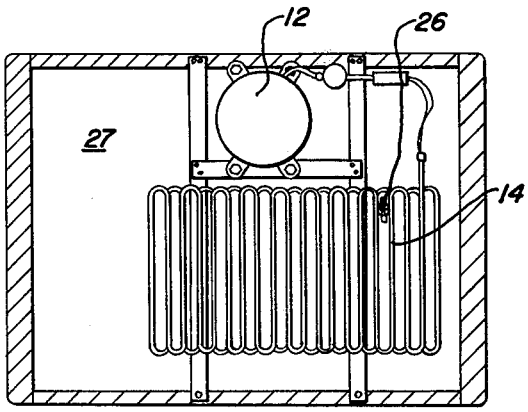
FIG. 5

CONDITION RESPONSIVE LIQUID LINE VALVE FOR REFRIGERATION APPLIANCE

BACKGROUND OF THE INVENTION

1. Field of the Invention

This invention relates to refrigeration systems and in particular to means for controlling the delivery of refrigerant fluid from the compressor thereof.

2. Background Art

In conventional refrigeration systems, a compressor is utilized to compress the refrigerant which has vaporized in the evaporator, and the compressed refrigerant is passed through a condenser so as to be returned to the evaporator in liquid form. The operation of the compressor is controlled by a thermostat which senses the temperature of the space being refrigerated so as to cycle the refrigeration system as needed to maintain a desired temperature range. When the compressor is de-energized by the thermostat as a result of the sensed temperature dropping to the desired preselected temperature, some refrigerant may flow from the condenser to the evaporator. This flow is undesirable as it tends to warm the evaporator. It also permits the liquid refrigerant in the capillary leading to the evaporator to gasify, thereby requiring a period of liquid delivery to the capillary upon subsequent restarting of the compressor before normal operation of the refrigeration system is again obtained.

In one conventional form of refrigeration system, the compressor comprises a rotary compressor which is capable of starting under relatively high discharge pressures. However, where such discharge pressures are caused to be extremeley high, such as under high ambient temperature conditions, it is desirable to provide some means for reducing the excessive pressure.

A number of different approaches have been taken in the background art relative to controlling the flow of refrigerant in refrigeration systems. Illustratively, as shown in U.S. Pat. No. 1,836,072 of Harry B. Hull, a refrigerating apparatus includes a control which senses the temperature of the condenser for modulating the refrigerant flow from the condenser to the evaporator. The functioning of the valve is to maintain a constant evaporator pressure.

In U.S. Pat. No. 2,245,454, Marshall W. Baker shows a refrigerating apparatus utilizing a valve between the capillary and evaporator for sensing the pressure of the evaporator and utilizing this pressure in controlling the refrigerant flow.

Lloyd A. Staebler et al, in U.S. Pat. No. 2,687,020, shows a refrigeration apparatus having valve means for switching refrigerant flow between two different capillary tube-evaporator systems. This system maintains a refrigerant flow circuit open at all times either to the freezer evaporator or the refrigerator evaporator.

In U.S. Pat. No. 3,199,306 of Bruce M. Paul, a refrigeration apparatus control circuit is shown having a valve upstream of an expansion device. The valve is controlled by the suction line temperature and is opened whenever a switch responsive to the suction line temperature calls for cooling. The circuit is arranged to concurrently start the compressor and open the control valve.

Glendon A. Raymond, in U.S. Pat. No. 3,677,028 shows a refrigeration system having a solenoid-operated valve upstream of the capillary, which is caused to open and close as a function of the compressor energization.

In U.S. Pat. No. 3,722,228, Russell T. Smith shows a refrigeration system wherein a capillary is connected between the condenser and evaporator, permitting flow therebetween at all times. Smith shows a flow control valve for controlling both the inlet and outlet of the compressor so as to prevent refrigerant migration during the shutdown interval.

Ettore Funaro, in U.S. Pat. No. 3,884,663 shows a refrigeration system having a normally closed solenoid valve connected between the condenser and a plurality of parallel connected capillary tubes. The valve is cycled with the compressor.

In U.S. Pat. No. 4,067,203, Joseph L. Behr shows a refrigeration system having an electronically controlled expansion valve maintaining the evaporator thereof in flooded condition. In one form, the control includes means for sensing the temperature of the compressor sump, the ambient air, etc., for opening the expansion valve. In another form, the control senses the temperature of two points of the evaporating coil. The control effectively functions to permit the system to operate with the evaporator in a flooded stage without damage to the compressor.

SUMMARY OF THE INVENTION

The present invention comprehends an improved refrigeration system which is arranged to prevent migration of refrigerant fluid from the condenser to the evaporator when the compressor is shut down. The system, however, includes means for preventing excessively high pressure conditions from arising at the discharge outlet of the compressor, such as the result of a high ambient temperature condition.

The invention comprehends the provision of means for effectively determining the pressure condition at the discharge of the compressor and causing a reduction in that pressure in the event it rises above a preselected pressure.

More specifically, the invention utilizes means sensing an analog of the refrigerant fluid pressure in making the pressure determination. In the illustrated embodiment, the sensed parameter alternatively may be the temperature of the condenser, or the temperature of the ambient atmosphere in the machinery compartment of the refrigeration apparatus. In either case, the sensed temperature corresponds to the pressure condition at the outlet of the compressor so as to permit suitable control of the refrigerant fluid pressure thereat.

The control includes a normally open valve connected between the condenser and the fixed flow restrictor, which, in the illustrated embodiment, comprises a capillary tube. The valve is caused to be opened or closed as a function of the sensed pressure condition and as a function of the operating condition of the compressor. More specifically, the valve is maintained open at all times during operation of the compressor and, under normal pressure conditions, is closed upon termination of the operation of the compressor during the normal refrigeration cycles.

However, the control further includes means for causing the valve to open in the event that the sensed pressure becomes excessive.

In the illustrated embodiment, the control is arranged to maintain the valve open when the ambient temperature within the machinery compartment is above a preselected temperature, such as approximately 110–115°

F. Thus, while the compressor may comprise a rotary compressor which is capable of starting under relatively high discharge pressures, the valve assures that excessive pressures will be relieved before attempted starting of the compressor so as to reduce the likelihood of damage to the compressor.

This improved functioning, however, is provided in combination with an improved control of the refrigeration system wherein flow of refrigerant fluid from the compressor to the evaporator is positively halted upon termination of the operation of the compressor. Thus, refrigerant fluid migration is effectively precluded during off cycles in the normal operation of the refrigeration system at normal ambient temperatures.

Thus, the refrigeration system of the present invention provides an improved energy efficient system by preventing undesirable heating of the evaporator during the off cycles of the compressor. It has been found that the present invention provides an energy saving of approximately six to nine percent of the energy required by similar refrigeration systems not provided with the improved refrigerant fluid control. The refrigeration system of the invention is extremely simple and economical of construction while yet providing this improved functioning.

BRIEF DESCRIPTION OF THE DRAWING

Other features and advantages of the invention will be apparent from the following description taken in connection with the accompanying drawing wherein:

FIG. 1 is a perspective view of a refrigeration apparatus having a refrigeration system embodying the invention;

FIG. 2 is a schematic wiring diagram showing the control of the refrigeration system;

FIG. 3 is a schematic flow diagram illustrating the refrigerant fluid system thereof;

FIG. 4 is a fragmentary horizontal section illustrating one arrangement of the temperature sensing means utilized in the refrigeration system; and FIG. 5 is a view similar to that of FIG. 4 but illustrating another arrangement of the sensing means.

DESCRIPTION OF THE PREFERRED EMBODIMENT

In the illustrative embodiment of the invention as shown in the drawing, a refrigeration system generally designated 10 is provided for use in a conventional refrigerator-freezer apparatus generally designated 11. As will be obvious to those skilled in the art, the refrigeration system may be utilized with a wide range of refrigeration apparatuses, refrigerator-freezer apparatus 11 being exemplary only.

Refrigeration system 10 illustratively includes a compressor 12 which may preferably comprise a rotary compressor, because such compressors are typically capable of starting under relatively high system pressures at the discharge outlet 13 thereof. The compressed refrigerant is delivered from outlet 13 through a condenser 14 in series with a flow restrictor 15 to an evaporator 16. The compressed refrigerant fluid is condensed in condenser 14 and is delivered through the restrictor 15 as a liquid. The liquid evaporates in evaporator 16 so as to effect a heat transfer to the fluid which is then passed through an accumulator 17 and a suction line 18 to the suction inlet 19 of the compressor 12 for recompression thereof. As shown in FIG. 3, the compressor 12 may include a precooler 20 through which the returned refrigerant is passed to precool it prior to delivery as compressed fluid to the condenser 14. As further shown in FIG. 3, the condenser may be provided with a cooling fan 21 for transferring heat from the refrigerant to the ambient atmosphere. As further illustrated in FIG. 3, a drier-strainer 22 may be provided at the outlet of the condenser 14.

The invention comprehends the provision of a valve 23 connected between the drier-strainer 22 and capillary 15 and, thus, effectively, in the refrigeration system between the condenser and evaporator. Valve 23 may be provided with an electrically energizable solenoid operator 24. In the illustrated embodiment, valve 23 comprises a normally open valve which is closed by energization of solenoid 24.

Valve 23 is suitably controlled by solenoid 24 so as to be open during operation of compressor 12 and to close upon termination of the operation of the compressor so as to prevent migration of refrigerant fluid from the condenser 14 to the evaporator at that time. By preventing such migration, as discussed above, an improved energy efficient operation of the refrigeration system is obtained. It has been found, however, that such closing of the flow path between the condenser and compressor may cause damage to the compressor if the closing is maintained under conditions wherein excessively high pressure is produced in the condenser and, thus, at the discharge outlet 13 of the compressor. As discussed above, such an excessive high pressure condition may be the result of a high ambient temperature.

As indicated briefly above, the control generally designated 25 is arranged to determine the pressure condition at the outlet 13 of the compressor as a function of a temperature condition which is correlated therewith. Thus, as shown in FIG. 2, the control 25 includes a temperature responsive switch generally designated 26 connected in series with the solenoid 24 of valve 23. As shown in FIG. 4, the temperature responsive switch 26 may be disposed in the machinery space 27 housing the compressor, etc. As illustrated in FIG. 1, the machinery space may be disposed at the bottom of the refrigeration apparatus as one exemplary location thereof. In this location, the switch 26 senses the temperature of the ambient air in the machinery space which, as discussed above, is related to the pressure developed in the refrigeration system when valve 23 is closed at termination of operation of compressor 12.

As illustrated in FIG. 5, the thermostat switch 26 may alternatively be mounted to condenser 14 so as to utilize the temperature thereof as an analog of the pressure of the refrigerant fluid therein.

As further shown in FIG. 2, control 25 is connected to 120 volt AC power supply leads L1 and L2. A defrost heater 38 is connected through a defrost timer 28 to power supply lead L1 and through a defrost bimetal thermostat control 29 to power supply lead L2. Timer 28 includes a timer motor 30 which controls the position of a moving contact 31*a* of a single pole, double throw switch 31. The switch further includes a first fixed contact 31*b* and a second fixed contact 31*c*.

Timer switch contact 31*b* is connected through the refrigerator apparatus thermostat 32 to a lead 33. Moving contact 31*a* is connected to power supply lead L1. Fixed contact 31*c* is connected through the timer motor 30 to the lead 33 and is connected to the defrost heater 38. An evaporator fan motor 34 is connected from lead 33 to power supply lead L2 and the condenser fan motor 35 is connected from lead 33 to power supply lead L2 in parallel therewith. Compressor motor 12 is connected from power supply lead L2 through a conventional compressor relay 36 and an overload protective control 37 to lead 33. The series connection of switch 26 and valve solenoid 24 is connected between power supply lead L1 and lead 33. As will be obvious to those skilled in the art, the full refrigeration apparatus control may include further components. However, for a complete understanding of the present invention, the portion of the control shown in FIG. 2 is sufficient.

The functioning of the improved refrigerant flow control may be seen with reference to FIGS. 2 and 3. Upon termination of operation of compressor 12 by an opening of the refrigeration apparatus thermostat switch 32, valve solenoid 24 is energized in the event the temperature sensed by switch 26 is below the preselected temperature, such as 110° F. As valve 23 is a normally open valve, energization of the solenoid 24 closes the valve and, thus, immediately prevents further flow of refrigerant fluid to the restrictor 15 and evaporator 16, thereby preventing delivery of hot refrigerant fluid to the evaporator which, as discussed above, would lower the efficiency of the refrigeration system. As long as the sensed temperature remains below the preselected value, switch 26 remains closed and, thus, prevents such transfer of refrigerant fluid to the evaporator until such time as the compressor is restarted by the subsequent reclosing of thermostat switch 32.

Upon reclosing of switch 32, solenoid 24 is effectively shunted by the connection of switch 32 between lead 33 and power supply lead L1 through the timer switch 31. Thus, solenoid 24 is maintained de-energized during operation of the compressor motor 12 to assure an open condition of valve 23 during such operation. However, due to the series connection of the thermostat switch 32 with defrost switch contact **31*b*, the solenoid 24 will not be shunted by switch 32 during a defrosting operation. The solenoid 24** can therefore be energized during defrost to prevent the flow of refrigerant into the evaporator, this being highly desirable because additional refrigerant in the evaporator requires the application of additional heat, and hence, energy, during defrost.

As discussed above, the switch 26 is normally closed to provide the circuit to the valve solenoid 24 for energizing the solenoid when switch 32 opens. However, in the event the sensed temperature controlling switch 26 is above a preselected temperature, switch 26 opens and, thus, de-energizes solenoid 24 notwithstanding the open condition of thermostat switch 32. Thus, for example, if the ambient temperature in the machinery space 27 is above 110° F., switch 26 will effectively maintain valve 23 open notwithstanding the de-energization of compressor motor 12.

As discussed above, the temperature at which the switch 26 is set to open may be suitably selected to correspond to the desired maximum permitted pressure condition in the refrigerant fluid at the outlet of the compressor. Thus, the specific switch temperature rating may vary as a function of the specific disposition thereof. Illustratively, where the switch 26 is placed in heat transfer association with the condenser, as shown in FIG. 5, a suitable range of operation has been found to be one wherein the switch opens at approximately 119° F. and closes at approximately 104° F. Where the switch 26 is disposed, as illustrated in FIG. 4, in thermal transfer association with the air in the machinery space 27, the switch may be selected to remain closed up to a temperature of approximately 110°–115° F., as discussed above.

The use of valve 23 and its associated control 25 effectively eliminates liquid slugging in the suction line upon start-up of the compressor 12 and further eliminates the undesirable sweating that is associated with liquid slugging. Use of valve 23 also permits the refrigerant charge to be less critical than in conventional refrigeration systems.

The valve solenoid 24 is preferably a low power solenoid and, in the illustrated embodiment, comprises a six-watt solenoid. Notwithstanding the use of this power by the solenoid, the total power consumption of the refrigeration apparatus illustrated in FIG. 1 was found to be reduced by from six to nine percent through the use of the improved flow controlling valve by the improved control 25.

There are several reasons why the present invention provides an improvement in the operating efficiency of a refrigeration system. The refrigeration system may now start to cool immediately after the compressor 12 is re-energized because the use of valve 23 assures, under normal conditions, that liquid will cover the capillary tube entrance substantially at the time of re-energization of compressor 12, thereby eliminating the inefficient delivery of refrigerant fluid gas through the capillary tube to the evaporator, as occurs in the conventional system at re-energization of the compressor. Those skilled in the art will appreciate that the present invention maintains a lower average evaporator temperature by keeping warm refrigerant from entering the evaporator during off cycles. It will also be appreciated that, by maintaining the system pressures during off cycles, heat absorption by the condenser is reduced or eliminated and separation of refrigerant from the compressor oil is minimized.

Another highly desirable feature of the control is the fail-safe arrangement of valve 23. Thus, if the solenoid coil fails, all that may happen in the system is that the valve 23 remains open at all times. While such operation would prevent the provision of the energy conservation normally provided by the control 25, the refrigeration apparatus would not be damaged by a closed fluid circuit to the evaporator during operation of the compressor. A similar fail-safe feature is provided in the event the temperature responsive switch 26 fails open. In the event the switch 26 fails closed, the refrigeration apparatus will continue to function to maintain desired cabinet temperature, although the compressor might overload during a start cycle under conditions causing a higher than normal pressure at the compressor outlet 13 during the off cycle.

As the additional apparatus required in the control 25 over that of the conventional refrigeration apparatus controls is the solenoid valve 23 and temperature responsive switch 26 which are wired in to the control in the simple manner illustrated in FIG. 2, the increased cost of the improved refrigeration system may be quickly recovered in the energy saving.

The foregoing disclosure of specific embodiments is illustrative of the broad inventive concepts comprehended by the invention.

I claim:

1. In a refrigeration system having a refrigerant fluid compressor having a suction inlet and a high pressure fluid outlet, a condenser connected to said compressor outlet for receiving compressed refrigerant therefrom, and an evaporator connected to said compressor suction inlet, a fluid flow control means connected between said condenser and evaporator comprising:

a fixed restrictor;

a valve for controlling refrigerant fluid flow through the restrictor; and means for controlling said valve to permit fluid flow therethrough whenever the compressor is running, and when the compressor is not running only in the event the pressure at the outlet of the compressor is above a preselected undesirable pressure, thereby to effect reduction of said pressure to below said preselected pressure to permit subsequent starting of the compressor.

2. The refrigeration system of claim 1 wherein said restrictor comprises a capillary tube.

3. The refrigeration system of claim 1 wherein said valve is connected between said condenser and said restrictor.

4. The refrigeration system of claim 1 wherein said valve comprises a normally open valve.

5. In a refrigeration system having a refrigerant fluid compressor having a suction inlet and a high pressure fluid outlet, a condenser connected to said compressor outlet for receiving compressed refrigerant therefrom, and an evaporator connected to said compressor suction inlet, a fluid flow control means connected between said condenser and evaporator comprising:

a fixed restrictor;

a valve for controlling refrigerant fluid flow through the restrictor; and means for controlling said valve to permit fluid flow therethrough whenever the compressor is running, and when the compressor is not running only in the event a sensed temperature condition corresponding to a preselected undesirable pressure at the outlet of the compressor is above a preselected temperature corresponding to said preselected pressure, thereby to effect reduction of said pressure to below said preselected pressure to permit subsequent starting of the compressor.

6. The refrigeration system of claim 5 wherein said sensed temperature comprises the temperature of the condenser.

7. The refrigeration system of claim 5 wherein said sensed temperature comprises an ambient temperature adjacent the condenser of approximately 110° F.

8. The refrigeration system of claim 5 wherein said valve comprises a normally open valve and includes an electrically operated solenoid for closing said valve, said valve controlling means comprising a temperature responsive switch for controlling operation of the compressor connected across said solenoid for selectively shorting out said solenoid.

9. In a refrigeration system having a rotary compressor having a suction inlet and a high pressure fluid outlet, a condenser connected to said compressor outlet for receiving compressed refrigerant therefrom, and an evaporator connected to said compressor suction inlet, fluid flow control means connected between said condenser and evaporator comprising:

a fixed restrictor;

a normally open valve for controlling refrigerant fluid flow through the restrictor; and means for closing said valve only in the event the compressor is not running and the pressure at the outlet of the compressor is below a preselected pressure, thereby to assure that said outlet pressure is below said preselected pressure upon attempted subsequent starting of the compressor.

10. The refrigeration apparatus of claim 9 wherein said valve includes electrical operating means, and said means for closing the valve comprises a control circuit having means for detecting operation of said compressor and means responsive to the pressure of the refrigerant fluid in said condenser, said pressure responsive means comprising means sensing an analog of the pressure of the refrigerant fluid.

11. The refrigeration apparatus of claim 10 wherein said pressure responsive means comprises means for sensing the temperature of the refrigeration fluid in the condenser.

12. In a refrigerant system having a rotary refrigerant fluid compressor having a suction inlet and a high pressure fluid outlet which cannot be started when the outlet pressure is above a preselected value, a condenser connected to said compressor outlet for receiving compressed refrigerant therefrom, and an evaporator connected to said compressor suction inlet, a fluid flow control means connected between said condenser and evaporator comprising:

a fixed restrictor;

a valve having electric operating means for controlling refrigerant fluid flow through the restrictor; and a control circuit for controlling said valve operating means to permit fluid flow therethrough whenever the compressor is running, and when the compressor is not running only in the event a sensed temperature condition related to the pressure at the outlet of the compressor is above a preselected temperature corresponding to said preselected pressure, said control circuit including temperature responsive switch means for sensing the temperature of the compressed refrigerant fluid upstream of the valve, and a switch, said switch being electrically associated with said valve electrical operating means for causing selective open and closed conditions of said valve as a function of the operation of said compressor and said sensed temperature.

13. The refrigeration system of claim 12 wherein said valve comprises a normally open valve which is closed upon energization of said electrical operating means, said electrical operating means comprising a solenoid connected in series with said temperature responsive switch and in parallel with a second switch controlling the energization of the compressor motor.

14. The refrigeration system of claim 12 wherein said valve comprises a normally open valve which is closed upon energization of said electrical operating means, said electrical operating means comprising a solenoid connected in series with said temperature responsive switch and in parallel with a second switch controlling the energization of the compressor motor, said second switch comprising a thermostat that is in series with said compressor.

15. In a refrigeration system having a source of AC power, a rotary compressor having a suction inlet and an outlet, a condenser connected to said compressor outlet for receiving compressed refrigerant therefrom, an evaporator coupled to said compressor inlet, and a capillary tube restrictor for supplying refrigerant to said evaporator from said condenser, an improved refrigerant flow control means comprising:

a temperature responsive switch arranged to sense a temperature indicative of the refrigerant pressure at said compressor outlet, said switch being normally closed at sensed temperatures below a predetermined temperature corresponding to an undesirably high refrigerant pressure condition at said outlet;

a normally open electrically operated valve connected between said condenser and said capillary tube for controlling the refrigerant flow to said capillary tube, said valve and said temperature responsive switch and said compressor being electrically connected in series across said AC power source;

a defrost switch having a contact normally closed during operation of the refrigeration system and open during defrosting operations; and a thermostat switch for controlling energization of said refrigeration system, said thermostat switch being electrically connected in series with said defrost switch and said compressor across said AC power source, said series connected thermostat switch and defrost switch being electrically connected in parallel with said series connected temperature responsive switch and electrically operated valve.

16. The refrigeration system of claim 15 wherein said electically operated valve comprises a solenoid valve that completely restricts refrigerant flow therethrough when energized.

17. The refrigeration system of claim 15 wherein said predetermined temperature corresponds to a pressure at said compressor outlet sufficiently high to prevent said compressor from starting.

* * * * *